US008662659B2

(12) United States Patent
Tsuji

(10) Patent No.: US 8,662,659 B2
(45) Date of Patent: Mar. 4, 2014

(54) RECORDING APPARATUS AND RECORDING/CUTTING CONTROL METHOD

(75) Inventor: Hiroyuki Tsuji, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 131 days.

(21) Appl. No.: 13/232,892

(22) Filed: Sep. 14, 2011

(65) Prior Publication Data

US 2012/0062678 A1 Mar. 15, 2012

(30) Foreign Application Priority Data

Sep. 15, 2010 (JP) ..... 2010-206405

(51) Int. Cl.
*B41J 2/01* (2006.01)
*B41J 29/38* (2006.01)

(52) U.S. Cl.
USPC ..... 347/104; 347/16; 347/101

(58) Field of Classification Search
None
See application file for complete search history.

(56) References Cited

U.S. PATENT DOCUMENTS 2,971,417 A * 2/1961 Hermann ..... 83/364
3,880,028 A * 4/1975 Frederick, Jr. ..... 83/880
4,130,275 A * 12/1978 Rozga ..... 271/251
4,133,235 A * 1/1979 Gerber ..... 83/74
5,188,470 A * 2/1993 Matsubara et al. ..... 400/621
5,355,156 A * 10/1994 Balzeit et al. ..... 346/138
5,774,777 A * 6/1998 Ohtsuka et al. ..... 399/384
6,520,701 B2 * 2/2003 Kaya ..... 400/621
8,181,556 B2 * 5/2012 Brandenburg et al. ..... 83/15
2003/0077100 A1 * 4/2003 Hakkaku ..... 400/621
2004/0182212 A1 * 9/2004 Harris et al. ..... 83/247
2007/0222144 A1 * 9/2007 Inui et al. ..... 271/291

FOREIGN PATENT DOCUMENTS

JP 2003-266832 A 9/2003

* cited by examiner

*Primary Examiner* — Stephen Meier
*Assistant Examiner* — Leonard S Liang
(74) *Attorney, Agent, or Firm* — Maschoff Brennan

(57) ABSTRACT

A recording apparatus includes a cutting execution unit that cuts a recording medium in a width direction by operating a cutter at a cutting position corresponding to the position of a image to be recorded on the recording medium with a hold down device being actuated (corresponding to S230), a cutter error detection unit that detects an operation error of the cutter which may occur during cutting by the cutting execution unit (corresponding to S240) and a cutting re-execution unit that restarts the cutter with the hold down device applying the increased pressing force to the recording medium, when an operation error of the cutter is detected by the cutter error detection unit. (corresponding to S270).

4 Claims, 8 Drawing Sheets

RECORDING APPARATUS AND RECORDING/CUTTING CONTROL METHOD

Priority is claimed under 35 U.S.C. §119 to Japanese Application No. 2010-206405 filed on Sep. 15, 2010 which is hereby incorporated by reference in its entirety.

BACKGROUND

1. Technical Field

The present invention relates to recording apparatuses that record images on an elongated recording medium and recording/cutting control method.

2. Related Art

Together with the increasing use of digital cameras in recent years, various recording apparatuses have been proposed in which digital image data are recorded with a quality comparable to that of silver halide photographs. For example, JP-A-2003-266832 discloses one of such recording apparatuses, which is configured to print a plurality of images on an elongated sheet wound in a roll (so-called roll paper) and cut the sheet by using an auto cutter into separate image sheets on which the respective images are printed.

In the above-mentioned auto cutter of the prior art, the degradation of the cutter blade over time may cause suspension of the cutter blade operation during cutting. It is preferable to restart the cutter blade if the cutter blade operation is suspended. In the above-mentioned prior art, however, sufficient measures to restart the cutter blade operation are not taken and it has been difficult to cut the sheet successfully by restarting the cutter blade operation.

SUMMARY

An advantage of some aspects of the invention is that a technique is provided in which a cutter is restarted upon the occurrence of an operation error of the cutter, thereby enabling successful cutting of the sheet.

The invention is provided to solve at least part of the above-mentioned problem and can be realized in the embodiments or applied examples as described below.

Applied Example 1

A recording apparatus including a transportation unit that transports an elongated recording medium in a predetermined transportation direction which is parallel to a longitudinal direction of the recording medium, an image recording unit that records a plurality of images on the recording medium, a cutter for the recording medium disposed at a position downstream of the image recording unit in the transportation direction, a hold down device that presses the recording medium with a predetermined pressing force and disposed at a position downstream of the cutter in the transportation direction, a cutting execution unit that cuts the recording medium in a width direction by operating the cutter at a cutting position corresponding to the position of the image to be recorded on the recording medium with the hold down device being actuated, a cutter error detection unit that detects an operation error of the cutter which may occur during cutting by the cutting execution unit, and a cutting re-execution unit that restarts the cutter with the hold down device applying the increased pressing force to the recording medium, when an operation error of the cutter is detected by the cutter error detection unit.

According to the recording apparatus of the applied example 1, since the recording medium is cut with the cutting execution unit by operating the cutter while the recording medium is pressed by the sheet hold down device at the position downstream of the cutter, the recording medium can be smoothly cut, preventing wrinkles from being formed on the recording medium. Further, when an operation error of the cutter is detected by the cutter error detection unit, the cutting re-execution unit increases the pressing force of the hold down device to the recording medium and restarts the cutter so that the surface of the recording medium is firmly pressed even if wrinkles are formed on the recording medium during cutting. As a result, the recording medium can be successfully cut even if an operation error has occurred. Therefore, this has an advantageous effect that the recording medium can be successfully cut by restarting the cutter after the operation error of the cutter occurs.

Applied Example 2

The recording apparatus according to the applied example 1, wherein the cutting re-execution unit includes a cutter returning unit that returns the cutter to a home position which serves as the start point of the operation and is configured to restart the cutter after the cutter is returned to the home position by the cutter returning unit.

According to the recording apparatus of the applied example 2, the cutter restarts the operation after returning to the home position from the position where the operation error has occurred. As a result, for example, in the case where the cutter has stopped due to wrinkles formed on the recording medium, the cutter can restart the operation after moving out of the area of the wrinkles, thereby ensuring a reliable operation.

Applied Example 3

The recording apparatus according to one of the applied examples 1 and 2, wherein the cutting re-execution unit includes a transportation execution unit that operates the transportation unit to transport the recording medium by a predetermined distance during the time period between returning of the cutter to the home position by the cutter returning unit and restarting of the cutter.

According to the recording apparatus of the applied example 3, cutting of the recording medium can be re-executed at the position different from where the cutting error has occurred by the cutting execution unit. Accordingly, it is possible to reliably cut the recording medium.

Applied Example 4

The recording apparatus according to the applied example 3, wherein the predetermined distance is equal to or more than a distance between a cutter blade of the cutter and the hold down device.

According to the recording apparatus of the applied example 4, when cutting of the recording medium is re-executed, the recording medium is pressed by the hold down device after the position on the recording medium where the cutting error has occurred is moved downstream of the hold down device. Accordingly, even if the recording medium has received damage from the cutting error, the cutting can be re-executed avoiding the damage, thereby ensuring reliable cutting of the recording medium.

Applied Example 5

The recording apparatus according to one of the applied examples 3 and 4, wherein the transportation execution unit transports the recording medium by a predetermined distance at a transport rate slower than a transport rate of the recording medium before execution of the cutting execution unit.

According to the recording apparatus of the applied example 5, even if wrinkles or breaks are formed on the recording medium at a position where cutting error has occurred, the recording medium can be transported by a predetermined distance without increasing the extent of the wrinkles or breaks.

Applied Example 6

The recording apparatus according to one of the applied examples 3 and 4, wherein the transportation execution unit executes transportation of the recording medium by a predetermined distance by using a roller disposed at a position upstream of the cutter in the transportation direction without using a roller disposed at a position downstream of the cutter in the transportation direction.

According to the recording apparatus of the applied example 6, even if wrinkles or breaks are formed on the recording medium at a position where cutting error has occurred, the recording medium can be transported by a predetermined distance without increasing the extent of the wrinkles or breaks.

Applied Example 7

A recording/cutting control method including transporting an elongated recording medium in a predetermined transportation direction which is parallel to a longitudinal direction of the recording medium, image recording for recording a plurality of images on the recording medium, cutting the recording medium in a width direction by operating a cutter for the recording medium at a cutting position corresponding to the position of the image to be recorded on the recording medium with a hold down device being actuated, the hold down device pressing the recording medium with a predetermined pressing force and being disposed at a position downstream of the cutter in the transportation direction, cutter error detecting for detecting an operation error of the cutter which may occur during cutting in the cutting, and cutting re-executing for restarting the cutter with the hold down device applying the increased pressing force to the recording medium, when an operation error of the cutter is detected in the cutter error detecting.

The recording/cutting control method of the applied example 7 has an advantageous effect that the recording medium can be successfully cut by restarting the cutter after the operation error of the cutter occurs, as similar to the recording apparatus of the applied example 1.

Further, the invention can be realized in various forms in addition to the above-mentioned applied examples 1 to 7. For example, the invention is applicable to a network system having a recording apparatus of the applied example 1, a computer program that executes each of the steps of the applied examples 7, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the attached drawings.

A. First Embodiment

A-1. Overall Configuration of the Printer Hardware Configuration

Figure 1:
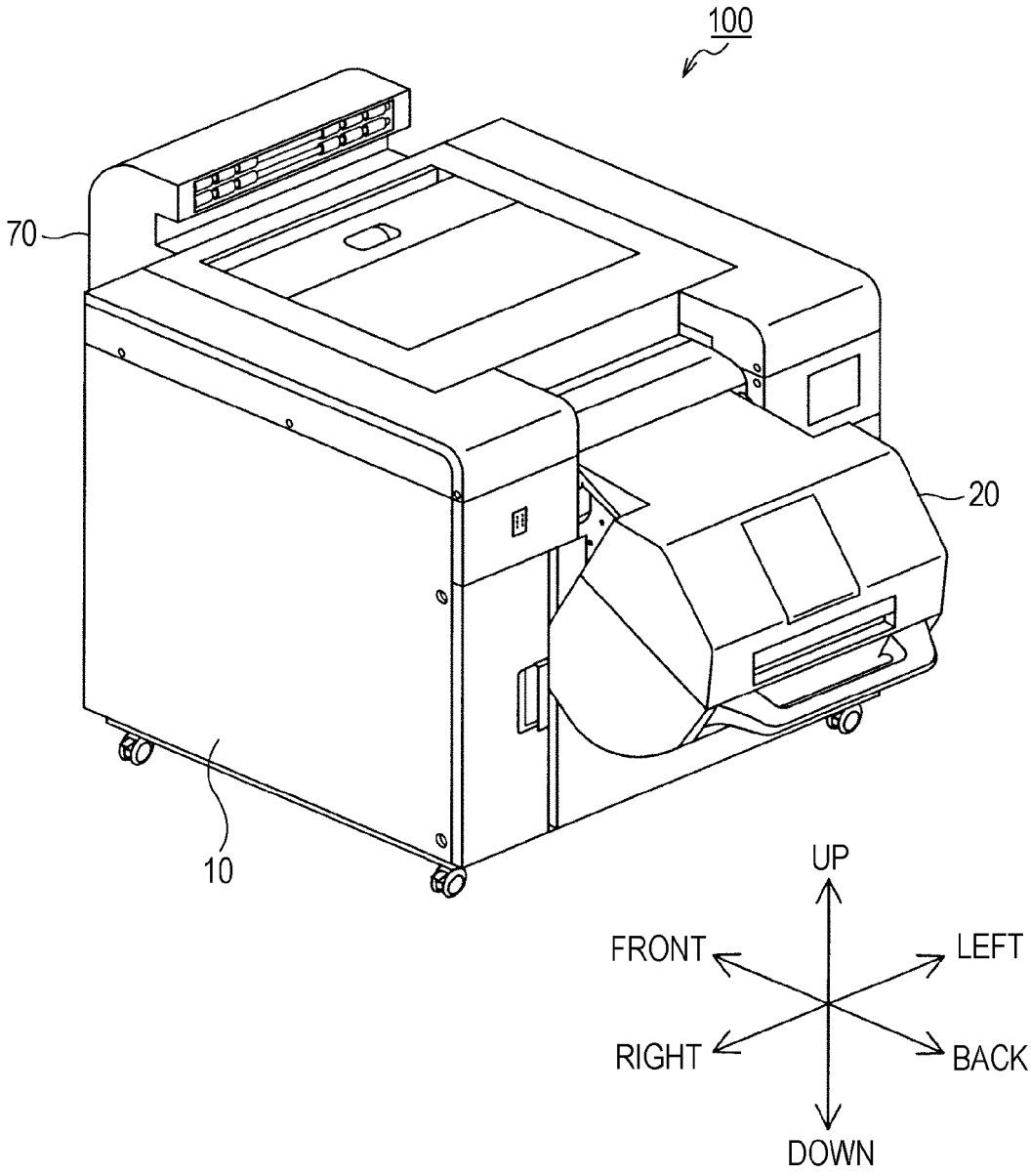
FIG. 1 is an exterior perspective view of an ink jet printer according to one embodiment of the invention.
Figure 2:
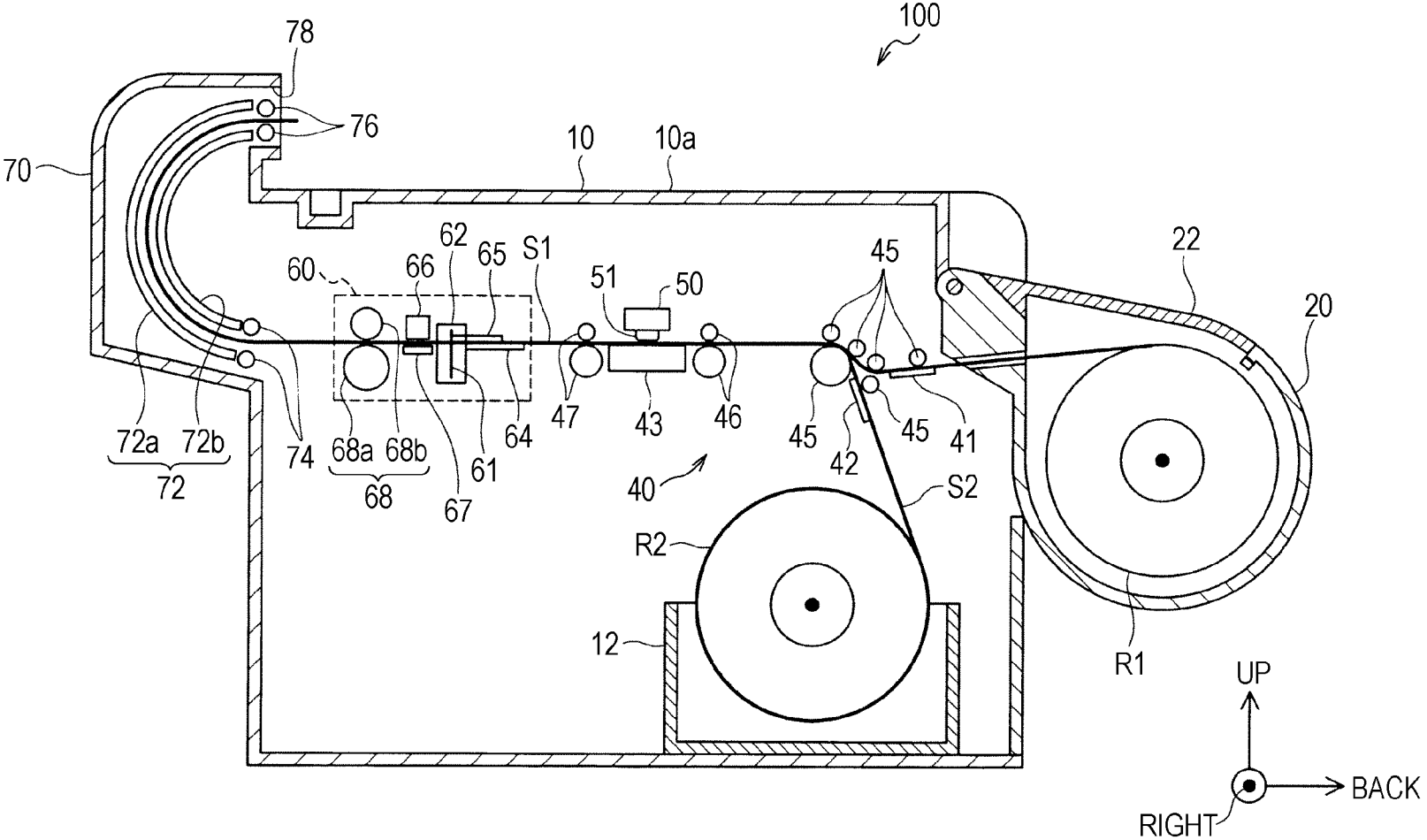
FIG. 2 is a schematic configuration view which schematically shows the internal configuration of the ink jet printer.

FIG. 1 is an exterior perspective view of an ink jet printer 100 according to one embodiment of the invention. FIG. 2 is a schematic configuration view which schematically shows the internal configuration of the ink jet printer 100. The terms "front-back direction," "up-down direction" and "left-right direction" as used herein refer to the "front-back direction," "up-down direction" and "left-right direction" as indicated by the arrows in FIG. 1 (or FIG. 2), respectively, unless otherwise specified.

As shown in FIG. 1, the ink jet printer (hereinafter simply referred to as "printer") 100 includes a paper feed unit 20 at the back of the printer body 10 and a paper discharge unit 70 at the front of the printer body 10 such that a sheet S1 as an elongated recording medium (FIG. 2) is fed from the paper feed unit 20 at the back of the printer body 10 and discharged through the paper discharge unit 70 at the front of the printer body 10.

As shown in FIG. 2, the paper feed unit 20 includes a roll container 22 capable of housing a roll R1 formed by winding the sheet S1 into a roll. When the roll R1 rotates about the core, the sheet S1 is unwound from the roll R1 and fed out of the roll container 22 to be transported downstream in the transportation direction.

Further, an openable door (not shown) is provided at the lower side on the outside of the printer body 10. Inside the openable door, there is disposed a tray 12, which is similar to the roll container 22, capable of housing a roll R2 formed by winding the sheet S2 as an elongated recording medium into a roll. When the roll R2 housed in the tray 12 rotates about the core, the sheet S2 is unwound from the roll R2 and fed out of the tray 12 to be transported downstream in the transportation direction.

The sheet S1 or the sheet S2 (also collectively referred to as "sheet S") which is unwound from the roll R1 or the roll R2 (also collectively referred to as "roll R") is transported into a transportation mechanism 40.

The transportation mechanism 40 includes a first receiving plate 41 that receives the sheet S1 which has been unwound from the roll R1 housed in the roll container 22 along the transportation path, and a second receiving plate 42 that receives the sheet S2 which has been unwound from the roll R2 housed in the tray 12 along the transportation path. The transportation mechanism 40 also includes a plurality of transportation rollers 45 and pairs of transportation rollers 46, 47, which are each disposed along the transportation path of the sheet S1 and the sheet S2, so as to transport the sheet S1 and the sheet S2 toward the support plate 43. The transportation mechanism 40 is configured to transport either one of the sheets S toward the support plate 43 by switching between the transportation path of the sheet S1 and the transportation path of the sheet S2.

The support plate 43 formed in a plate shape is capable of supporting the sheet S which has been transported from the transportation mechanism 40. A carriage 50 is disposed above the support plate 43 at the position opposing the support plate 43 so as to be movable in a reciprocating manner in a direction transverse to the transportation direction of the sheet S (left-right direction) by means of a drive unit (not shown). A recording head 51 is supported at the underside of the carriage 50. The underside of the recording head 51 is oriented horizontally and serves as a nozzle formation surface such that a plurality of nozzles (not shown) through which ink is ejected are open to the nozzle formation surface. The recording head 51 is configured to cooperate with the support plate 43 so as to perform recording on the sheet S transported therebetween by ejecting ink to the sheet S.

After recording is performed by the recording head 51, the sheet S is advanced into a cutter unit 60. The cutter unit 60 includes a cutter carriage 62 having a rotary cutter (hereinafter also referred to as "cutter blade") 61, a sheet guide 64 that guides the sheet S toward the cutter blade 61, a shear plate 65 that cooperates with the cutter blade 61 to shear the sheet S therebetween, a sheet hold down device 66 that holds down the sheet S during shearing, a pressure receiving plate 67 which is arranged opposite the sheet hold down device 66 and a pair of discharge rollers 68. The cutter blade 61, the sheet hold down device 66 and the pair of discharge rollers 68 are sequentially arranged downstream in the transportation direction of the sheet S.

Figure 3:
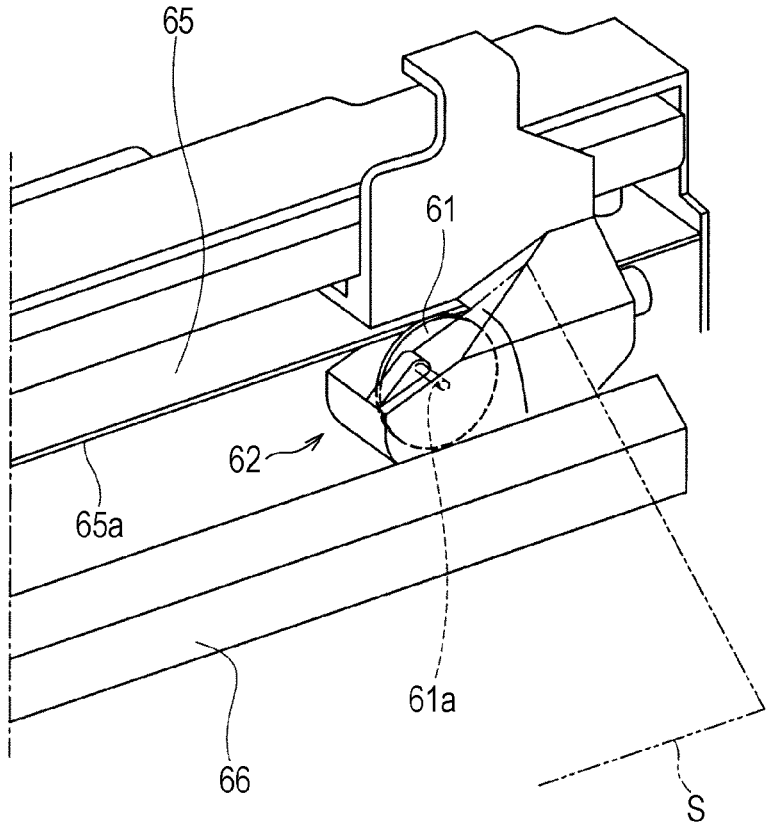
FIG. 3 is an explanation view showing the region around a cutter blade and a shear plate.

FIG. 3 is an explanation view showing the region around the cutter blade 61 and the shear plate 65. As shown in FIG. 3, the cutter blade 61 is formed in a disc shape and mounted on the cutter carriage 62 via a rotation shaft 61*a* that is parallel to the paper sheet transportation direction such that the cutter blade 61 is freely rotatable about the rotation shaft 61*a* while the outer periphery of the disc-shaped cutter blade 61 is in press contact with a downstream end 65*a* of the shear plate 65. The cutter carriage 62 is reciprocated in a direction perpendicular to the transportation direction of the sheet S (width direction of the sheet S, i.e., the left-right direction) by means of rotation drive of a cutter driving motor, which is described later. During this operation, the cutter blade 61 rotates while being in elastic contact with the end 65*a* of the shear plate 65 so as to cooperate with the shear plate 65 to shear (cut) the sheet S therebetween from the underside of the sheet S. As a result, the elongated sheet S is cut in the width direction.

Note that, during cutting, the transportation movement of the sheet S is suspended and the sheet S is pressed by the sheet hold down device 66 which is disposed downstream of the cutter blade 61. The sheet hold down device 66 has a cuboid shape whose longitudinal direction corresponds to the width direction of the sheet S and the width dimension is longer than that of the sheet S. A pressure receiving plate (see FIG. 2; not shown in FIG. 3) is disposed under the sheet hold down device 66. The sheet hold down device 66 moves in the up-down direction by means of a sheet hold down device moving mechanism, which is not shown, so as to cooperate with the pressure receiving plate 67 to nip the sheet S therebetween, thereby enabling a predetermined pressing force to be applied on the top surface of the sheet S. The sheet hold down device moving mechanism has a known configuration which is actuated by means of a driving force of a stepping motor, and the above-described predetermined pressing force is configured to be switchable between at least two stages.

Although the sheet hold down device 66 is described as being actuated by the stepping motor and the sheet hold down device moving mechanism, the configuration is not limited to that described above and other configurations, for example, in which a pressing force is hydraulically or pneumatically applied may be used.

The pair of discharge rollers 68 is composed of a driving roller 68*a* and a driven roller 68*b* which is in press contact with the driving roller 68*a*, and is configured to transport the sheet S which has been cut into the paper discharge unit 70 (FIG. 2) located downstream in the transportation direction.

The paper discharge unit 70 is for discharging the sheet S out of the printer 100 after recording has been performed by the recording head 51 and cutting has been performed by the cutter unit 60. The paper discharge unit 70 includes a reversing section 72 in which the sheet S is reversed and the pairs of transportation rollers 74, 76 that transport the sheet S. The reversing section 72 is composed of two guide plates 72*a* and 72*b* each having a substantially arc shape in sectional view. Both the guide plates 72*a* and 72*b* are arranged in parallel with and spaced apart from each other in the front-back direction. That is, a curved reversing path is formed between both the guide plates 72*a* and 72*b*.

The guide plates 72*a* and 72*b* are arranged such that the upper end of the guide plates 72*a* and 72*b* is located above a top face 10*a* of the printer body 10 in the up-down direction. The pair of transportation rollers 74 is arranged in the reversing section 72 at a position corresponding to the upstream end of the reversing path, while the pair of transportation rollers 76 is arranged at a position corresponding to the downstream end of the reversing path. That is, the pair of transportation rollers 76 is located above the top face 10*a* of the printer body 10 in the up-down direction.

The sheet S which has been cut by the cutter unit 60 is transported downstream and turned upside down while passing through the reversing path of the reversing section 72. Then, the sheet S which has been reversed is discharged through a discharge port 78 that is located at the front of the printer body 10 and above the top face 10*a* toward the back of the printer body 10.

Figure 4:
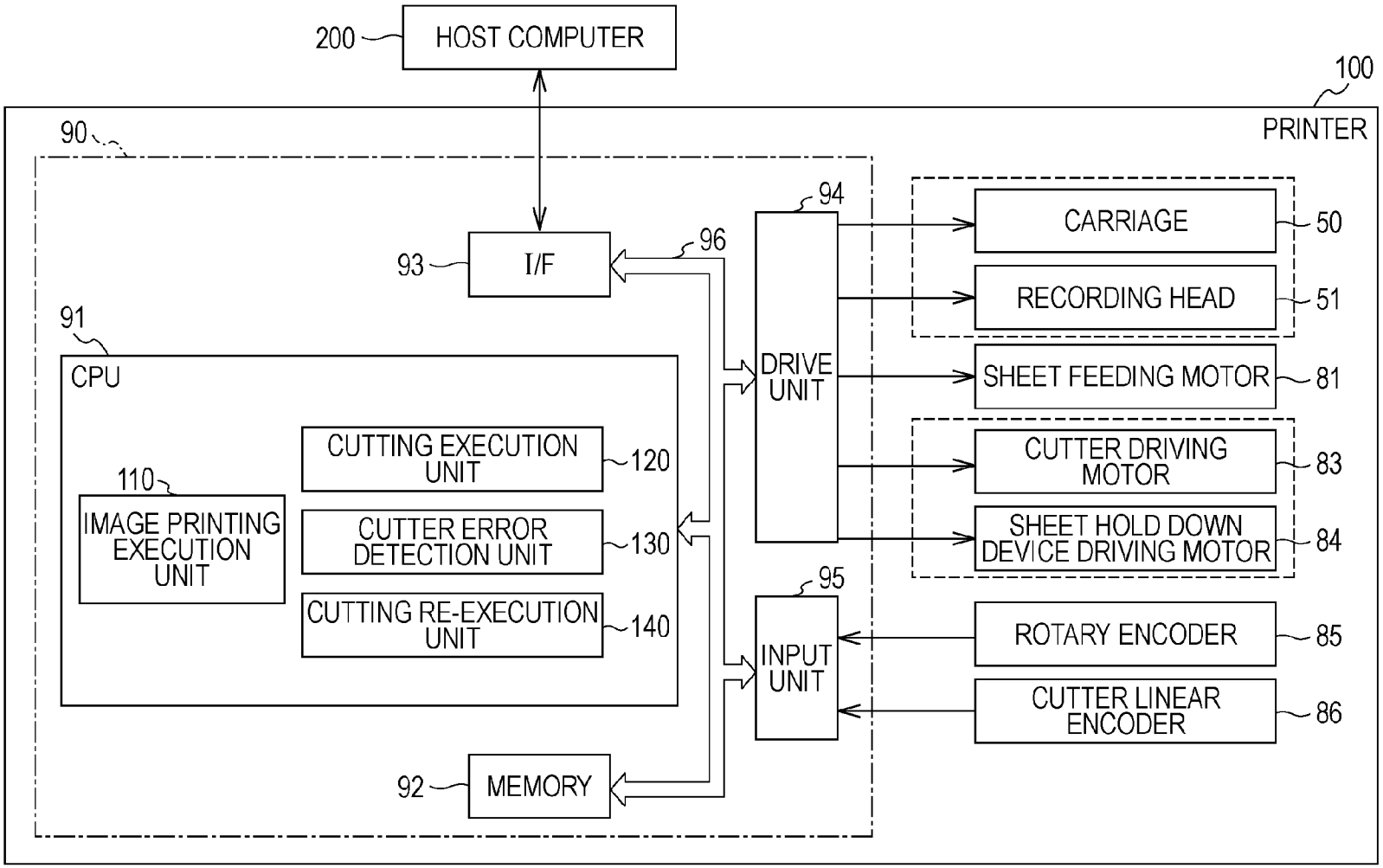
FIG. 4 is a block diagram showing an electrical configuration of the printer with a host computer.

FIG. 4 is a block diagram showing an electrical configuration of the printer 100 with a host computer 200. As shown in FIG. 4, the electrical configuration of the printer 100 includes a controller 90 as well as actuators, sensors and the like which are connected to the controller 90. The controller 90 mainly includes a CPU (central processing unit) 91, a memory 92, an I/F (interface) 93, a drive unit 94, an input unit 95 and the like. Each of the components 91 to 95 are interconnected via a bus 96.

The actuators include the above-mentioned carriage 50, the recording head 51, a sheet feeding motor 81, a cutter driving motor 83, a sheet hold down device driving motor 84 and the like. The transportation mechanism 40, the cutter unit 60 and the paper discharge unit 70 are provided with the transportation rollers 45, the pairs of transportation rollers 46, 47, the pair of discharge rollers 68, the pairs of transportation rollers 74, 76 and the like (FIG. 2). All the rollers are connected through a single sheet feeding motor 81 and a drive power transmission device, which is not shown. The rotation of the sheet feeding motor 81 causes all the above-mentioned rollers to be rotated. The cutter driving motor 83 is connected to the cutter carriage 62 of the paper discharge unit 70 so as to reciprocate the cutter carriage 62. The sheet hold down device driving motor 84 is a stepping motor that supplies a driving force to the above-mentioned sheet hold down device moving mechanism so as to move the sheet hold down device which is connected to the sheet hold down device moving mechanism. Those actuators are connected to the drive unit 94 which is provided in the controller 90.

The sensors include a rotary encoder 85, a cutter linear encoder 86 and the like, which are mounted on the rollers in the transportation mechanism 40. The rotary encoder 85 detects the rotation amount of the roller. The cutter linear encoder 86 detects the position of the cutter carriage 62 mounted on the cutter unit 60 (the position in the width direction of the sheet S). For example, the cutter linear encoder 86 has the following configuration; the cutter linear encoder 86 is composed of a code plate (not shown) having a shape elongated in the width direction, a light emitting member (not shown) that emits light to a plurality of slits arranged on the code plate in the main scan direction and a light receiving member (not shown) that receives the light which has passed through the slits, such that the absolute position of the cutter carriage 62 in the moving direction is detected through the rising signals and falling signals generated by the light which has passed through the plurality of slits. Both the rotary encoder 85 and the cutter linear encoder 86 are connected to an input unit 95 which is provided in the controller 90.

A host computer 200 is disposed on the outside of the printer 100. The host computer 200 is connected to the I/F 93 which is provided in the controller 90 such that data can be transmitted and/or received between the host computer 200 and the controller 90 via the I/F 93.

The memory 92 stores a computer program which enables printing of a plurality of images based on the data (i.e., print job data, which are described below in detail) that have been sent from the host computer 200 on the sheet S, and then cut the sheet S into separate image sheets on which the respective images are printed. When executing the computer program stored in the memory 92, the CPU 91 serves as an image printing execution unit 110, a cutting execution unit 120, a cutter error detection unit 130 and a cutting re-execution unit 140. The processes executed by each of the units 110 to 140 will be described below in detail.

A-2. Method for Image Printing and Cutting

Figure 5:
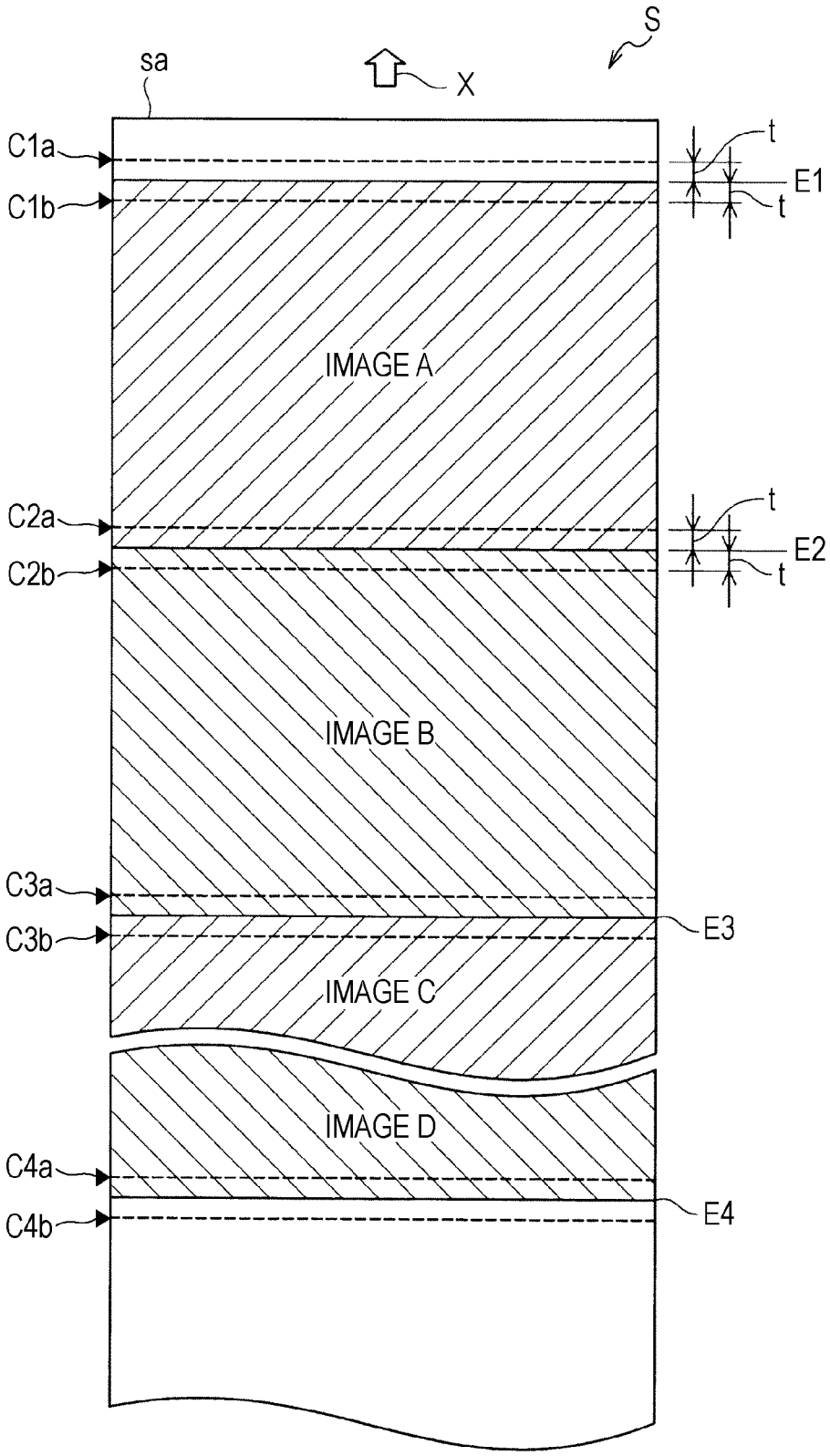
FIG. 5 is an explanation view showing one example of an elongated sheet S on which images are printed.

FIG. 5 is an explanation view showing one example of the elongated sheet S on which images are printed. In this embodiment, image A, image B, image C and image D (as indicated by the hatched areas) are sequentially printed on the sheet S in the transportation direction X of the sheet S as shown in FIG. 5. Specifically, the first image A is printed leaving a space from the distal end Sa of the sheet S, while the other images are continuously printed without leaving a space between two adjacent images, that is, between the image A and the image B, and the image B and the image C.

Printing of a plurality of images A to D is performed by the operation of the CPU 91 which serves as the image printing execution unit 110 (FIG. 4). That is, the CPU 91 drives the recording head 51 while reciprocating the carriage 50, and also drives the sheet feeding motor 81 so as to control printing of the images, taking the width direction of the sheet S as a main scan direction and the length direction of the sheet S as a sub-scan direction.

The sheet S which is shown in FIG. 5 is cut in the width direction of the sheet S into separate image sheets on which the images A, B, C and D are respectively printed. The above-mentioned separation into the individual image sheets is performed by cutting the sheet S at two positions for each of the images A to D in the transportation direction X, leaving margins in the front-back direction in the longitudinal direction of the sheet S (downstream and upstream in the transportation direction) with respect to the interface positions. The interface positions for the images A to D in the transportation direction X are represented as an interface position E1 which is located downstream of the first image A in the transportation direction X (hereinafter referred to as "leading position"), the interface positions E2 and E3 which are located between the two adjacent images and an interface position E4, which is located upstream of the image D in the transportation direction X (hereinafter referred to as "trailing position"). The positions C1*a*, C1*b*, C2*a*, C2*b*, C3*a*, C3*b*, C4*a* and C4*b* at which the sheet is cut are indicated by the solid arrowheads in FIG. 5. That is, cutting is performed at two positions (C1*a*, C1*b*), (C2*a*, C2*b*), (C3*a*, C3*b*), (C4*a*, C4*b*) for each of the respective interfaces E1 to E4, leaving margins in the front-back direction in the longitudinal direction of the sheet S at a predetermined distance t (for example, 1.5 mm) with respect to each interface E1 to E4. The above-mentioned cutting, which is performed by leaving margins in the front-back direction at the distance t, is hereinafter referred to as the W cutting process.

Cutting of the sheet S is performed by the operation of the CPU 91 which serves as the cutting execution unit 120 (FIG. 4). That is, while driving the sheet feeding motor 81, the CPU 91 drives the cutter driving motor 83 at the above-mentioned positions of cutting (hereinafter also referred to as "cutting positions"), thereby performing cutting control so as to obtain the image sheets on which the respective images are printed.

A-3. Software Configuration

A job printing control process includes the above-mentioned image printing control and cutting control and will be described below in detail. The job printing control process is a printing control process based on the print job data which have been sent from the host computer 200.

Figure 6:
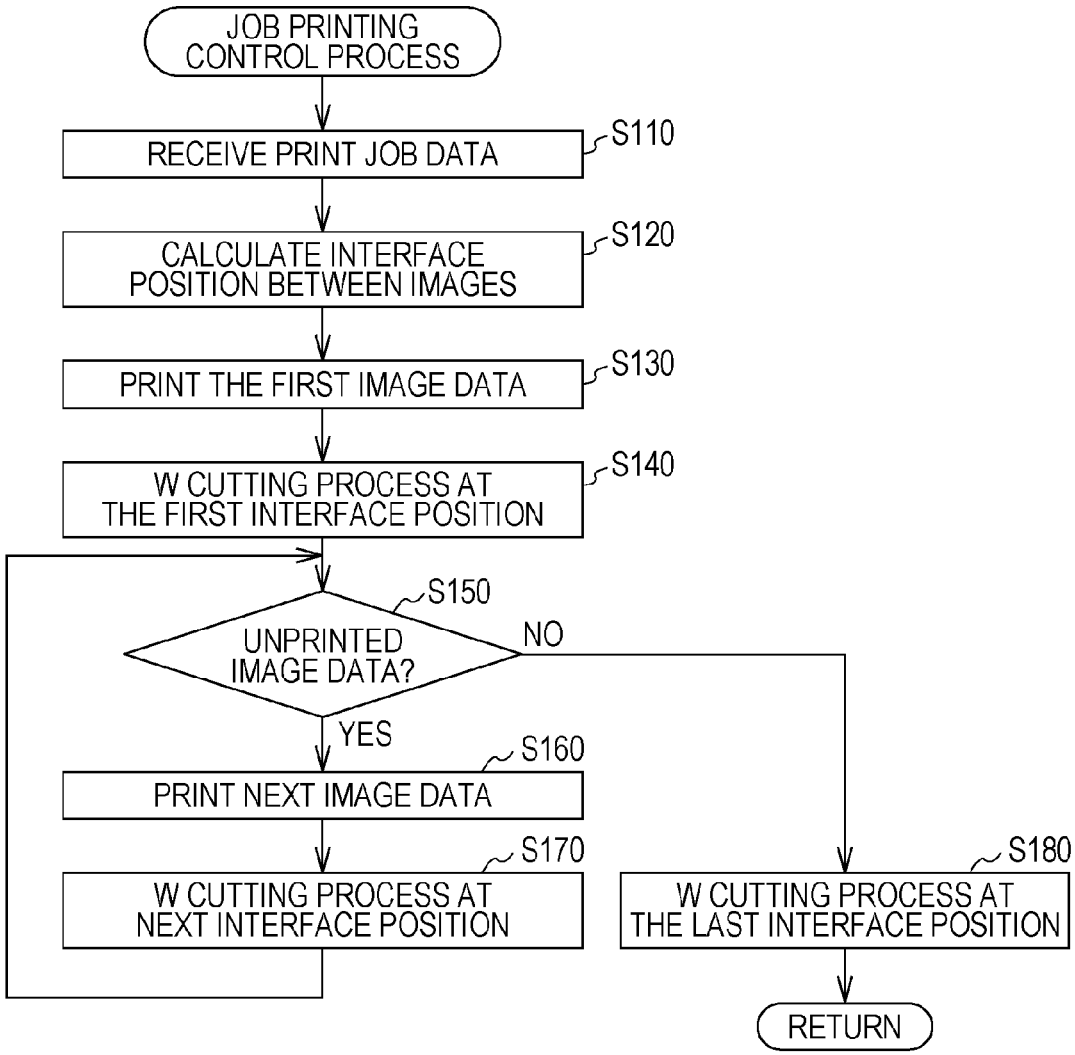
FIG. 6 is a flow chart of a job printing control process which is performed by a CPU.

FIG. 6 is a flow chart of a job printing control process which is performed by the CPU 91 of the controller 90. In the flow chart, although a process in which the sheet S is transported by means of driving of the sheet feeding motor 81 is not described in detail, the sheet S is appropriately transported as necessary. As shown in FIG. 6, once the process started, the CPU 91 receives the print job data which have been sent from the host computer 200 (step S110). The print job data is an image data set that includes one or more image data indicative of the image.

Then, the CPU 91 calculates the interface positions in the transportation direction X for each of the images (step S120). The images are represented by the respective image data, and the interface positions for the images to be printed on the sheet S are calculated based on the size and print resolution of the respective image data included in the print job data. According to the example which is shown in FIG. 5, the interface positions to be calculated are the leading position E1 of a sequence of a plurality of images A to D, the interface positions E2 and E3 between the image A and the image B, the image B and the image C, the image C and the image D, and the trailing position E4 of the sequence of a plurality of images A to D. The positions E1 to E4 are each expressed in terms of a distance from the distal end Sa of the sheet S.

After the completion of the step S120, the CPU 91 executes printing of first image data among a plurality of pieces of image data included in the print job data, which was received at the step S110 (step S130). The printing of the first image is performed as described above, leaving a space from the distal end Sa of the sheet S.

Then, the CPU 91 performs the above-mentioned W cutting process at the first interface position among the interface positions calculated in the step S120, that is, the leading position (step S140). Specifically, the CPU 91 i) defines a first cutting position which is apart from the leading position by a distance t in the front direction of the longitudinal direction of the sheet S (downstream in the transportation direction) and moves the cutter carriage 62 in the forward direction of the reciprocating motion by means of driving of the cutter driving motor 83 so that the sheet S is cut at the first cutting position and ii) defines a second cutting position which is apart from the leading position by a distance t in the back direction of the longitudinal direction of the sheet S (upstream in the transportation direction) and moves the cutter carriage 62 in the return direction of the reciprocating motion by means of driving of the cutter driving motor 83 so that the sheet S is cut at the second cutting position.

Then, the CPU 91 determines whether unprinted image data remains in the print job data, which was received in the step S110 (step S150). In the step S150, when the CPU 91 determines that unprinted image data remains, the next image data in the unprinted image data (that is, the second and subsequent image data) is printed (step S160). The unprinted image data is printed continuously from the previous image without a space therebetween, that is, in contact with the previous image.

After the completion of the step S160, the CPU 91 reads out the next interface position from the interface position calculated in the step S120, and performs the W cutting process at the read out interface position (step S170). Specifically, the CPU 91 i) defines a first cutting position which is apart from the interface position by a distance t in the front direction of the longitudinal direction of the sheet S (downstream in the transportation direction) and moves the cutter carriage 62 in the forward direction of the reciprocating motion by means of driving of the cutter driving motor 83 so that the sheet S is cut at the first cutting position and ii) defines a second cutting position which is apart from the interface position by a distance t in the back direction of the longitudinal direction of the sheet S (upstream in the transportation direction) and moves the cutter carriage 62 in the return direction of the reciprocating motion by means of driving of the cutter driving motor 83 so that the sheet S is cut at the second cutting position.

After the completion of the step S170 in which the W cutting process is performed, the CPU 91 returns to the step S150 and repeatedly performs the process of the step S150 and the subsequent processes. The CPU 91 performs the processes of the steps S150 to S170, thereby printing the third and subsequent image data and performing the W cutting process at the interface positions between the printed image and the previous image (E2 and E3 in the example of FIG. 5).

When the CPU 91 determines that unprinted image data does not remain in the step S150, the CPU 91 performs the W cutting process at the last interface position among the interface positions calculated in the step S120, that is, the trailing position (step S180). Specifically, the CPU 91 i) defines a first cutting position which is apart from the trailing position by a distance t in the front direction of the longitudinal direction of the sheet S (downstream in the transportation direction) and moves the cutter carriage 62 in the forward direction of the reciprocating motion by means of driving of the cutter driving motor 83 so that the sheet S is cut at the first cutting position and ii) defines a second cutting position which is apart from the trailing position by a distance t in the back direction of the longitudinal direction of the sheet S (upstream in the transportation direction) and moves the cutter carriage 62 in the return direction of the reciprocating motion by means of driving of the cutter driving motor 83 so that the sheet S is cut at the second cutting position. After the completion of the step S180, the CPU 91 terminates the job printing control process.

As described above, the W cutting process performed in the steps S140, S170 and S180 in the job printing control process includes cutting by the cutter carriage 62 moving in the forward direction of the reciprocating motion (hereinafter referred to as "first cutting") and cutting by the cutter carriage 62 moving in the return direction of the reciprocating motion (hereinafter referred to as "second cutting"). The following describes the detailed processes in the first cutting or the second cutting.

Figure 7:
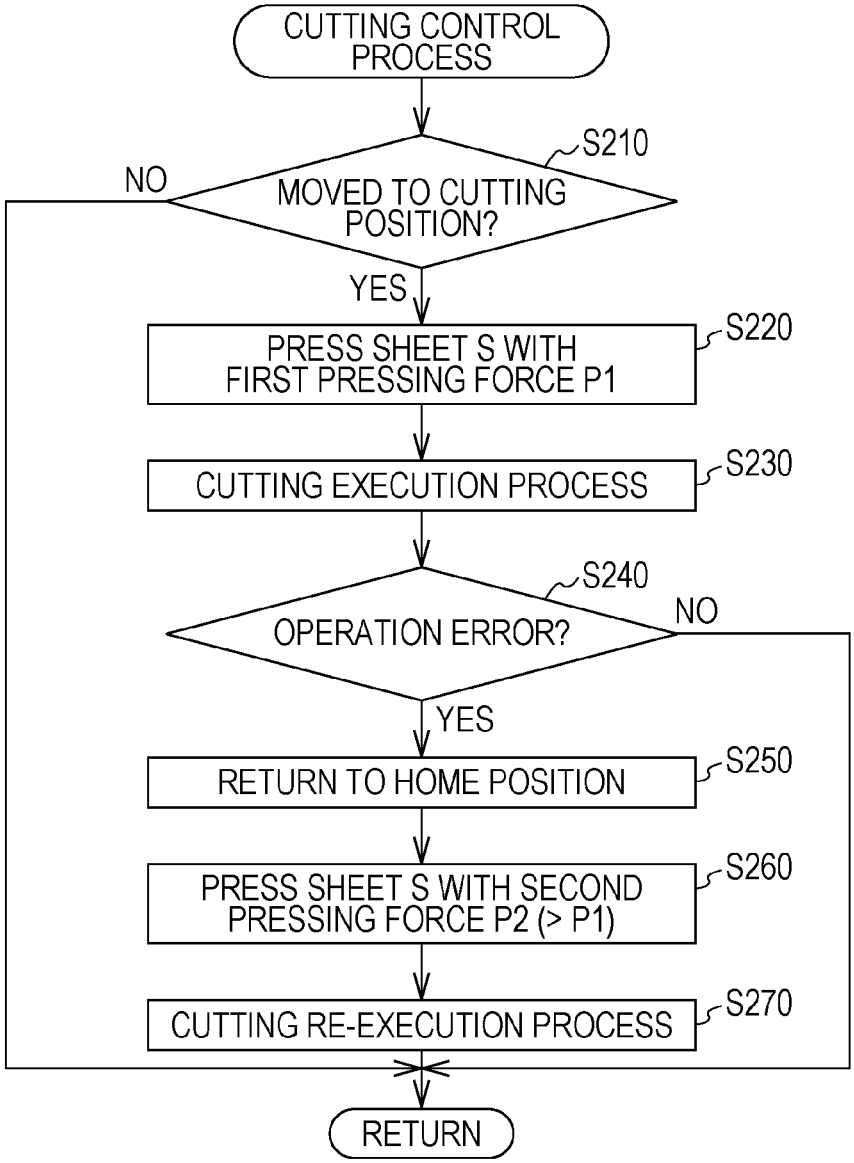
FIG. 7 is a flow chart of a cutting control process which is performed by the CPU.

FIG. 7 is a flow chart of a cutting control process which is performed by the CPU 91. The cutting control process of FIG. 7 is performed during the first cutting. Once the process starts, the CPU 91 determines whether the sheet S has been transported and the cutter blade 61 of the cutter unit 60 has moved relative to the first cutting position (step S210). When the CPU 91 determines that the cutter blade 61 has not moved relative to the first cutting position, the step goes to "return" to stop the cutting control process.

When the CPU 91 determines that the cutter blade 61 has moved relative to the first cutting position in the step S210, the CPU 91 drives the sheet hold down device driving motor 84 to actuate the sheet hold down device moving mechanism so that the sheet S is pressed with a first pressing force P1 by the sheet hold down device 66 (step S220). With the sheet S being pressed with the first pressing force P1, the CPU 91 rotates the cutter driving motor 83 in the positive direction so as to move the cutter carriage 62 in the forward direction of the reciprocating motion, thereby performing the cutting execution process so that the sheet S is cut at the first cutting position (step S230).

The CPU 91 then determines whether an operation error has occurred in which the cutter carriage 62 stops during the cutting execution process of the step S230 (step S240). In the step S240, whether the cutter carriage 62 has abnormally stopped or not is determined based on the absolute position of the cutter carriage 62 that is detected by the cutter linear encoder 86. When the CPU 91 determines that an operation error has not occurred in the step S240, the step goes to "return" to stop the cutting control process. As a consequence, the sheet S is cut at the first cutting position without problem.

When the CPU 91 determines that an operation error has occurred in the step S240, the CPU 91 rotates the cutter driving motor 83 in the negative direction so as to move the cutter carriage 62 in the reverse direction, thereby returning the cutter carriage 62 to a home position (step S250). The "home position" is a start position for the cutter carriage 62 moving in the forward direction of the reciprocating motion.

After the completion of the step S250, the CPU 91 drives the sheet hold down device driving motor 84 to actuate the sheet hold down device moving mechanism so that the sheet S is pressed with a second pressing force P2 by the sheet hold down device 66 (step S260). The second pressing force P2 is greater than the first pressing force P1 of the step S220. With the sheet S being pressed with the second pressing force P2, the CPU 91 rotates the cutter driving motor 83 in the positive direction so as to move the cutter carriage 62 in the forward direction of the reciprocating motion, thereby cutting the sheet S again (cutting re-execution process: step S270). After that, the step goes to "return" to stop the cutting control process.

In the cutting control process, the processes of the steps S220 and S230 correspond to the cutting execution unit 120 (FIG. 4), the process of the step S240 corresponds to the cutter error detection unit 130 (FIG. 4), and the processes of steps S250 to S270 correspond to the cutting re-execution unit 140 (FIG. 4).

Although the above-mentioned cutting control process is performed during the first cutting in which the cutter carriage 62 moves in the forward direction of the reciprocating motion, a configuration is possible in which the cutting control process is performed during the second cutting in which the cutter carriage 62 moves in the return direction of the reciprocating motion. In this case, however, the following modification for the second cutting is necessary over the cutting control process during the first cutting. First, the step S210 is modified to determine whether the cutter blade 61 of the cutter unit 60 is relatively moved to the second cutting position. The cutting execution process of the step S230 and the cutting re-execution process of the step S270 are modified to rotate the cutter driving motor 83 in the negative direction to move the cutter carriage 62 in the return direction of the reciprocating motion so that the sheet S is cut at the second cutting position. In the step S250, the home position is modified to a position which serves as a start position for the cutter carriage 62 moving in the return direction of the reciprocating motion.

A-4. Effects of the Embodiment

In the printer 100 having the above-mentioned configuration, since the sheet S is cut while the sheet S is pressed by the sheet hold down device 66 at the position downstream of the cutter blade 61, the sheet S can be smoothly cut, preventing wrinkles from being formed on the sheet S. Moreover, in the printer 100, when an operation error occurs in which the cutter carriage 62 stops during cutting, the cutter carriage 62 is returned to the home position, and then, the cutter is restarted with the pressing force applied by the sheet hold down device 66 to the sheet S increased from the first pressing force P1 to the second pressing force P2. Consequently, the cutting can be successfully completed by ensuring the sheet S to be firmly pressed even if wrinkles are formed on the sheet S during cutting. As a result, the sheet S can be successfully cut even if an operation error has occurred. Therefore, according to the printer 100, this has an advantageous effect that the sheet S can be successfully cut by restarting the cutter unit 60 after the operation error occurs.

B. Second Embodiment

The second embodiment of the invention will be described. The printer according to the second embodiment has the same hardware configuration and other software configuration as those of the printer 100 of the first embodiment, except that cutting control processes (FIG. 7) executed in the CPU 91 are different. In the following description, the same references are used for the same configurations as those of the first embodiment.

Figure 8:
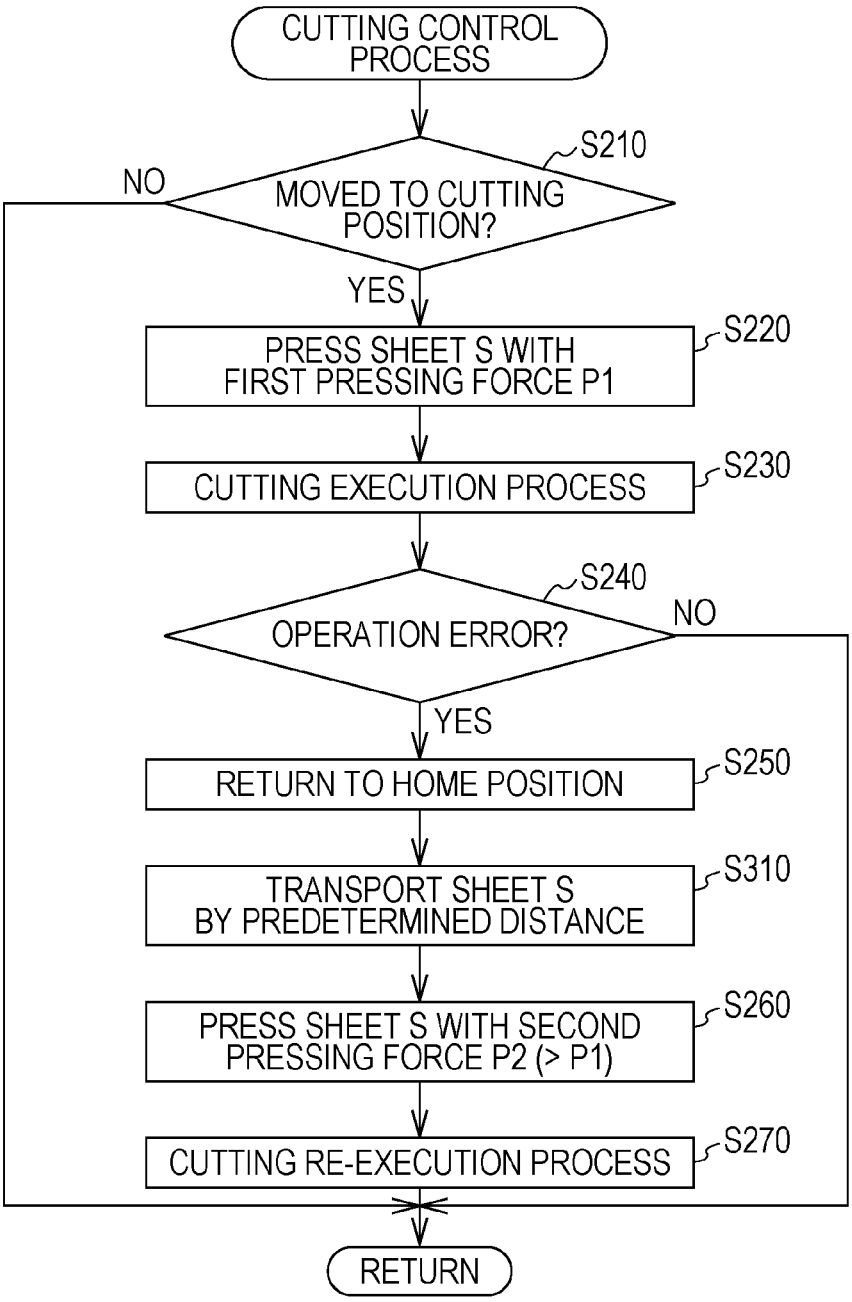
FIG. 8 is a flow chart of a cutting control process according to a second embodiment.

FIG. 8 is a flow chart of a cutting control process according to a second embodiment. The cutting control process has the same configuration as that of the steps S210 to S270 of the first embodiment, except that a step S310 is provided between the step S250 and the step S260.

In the step S310, the CPU 91 transports the sheet S by a predetermined distance. In this case, the predetermined distance is defined as a length equal to or more than the distance between the cutter blade 61 of the cutter unit 60 and the sheet hold down device 66. In other words, the predetermined distance is a distance necessary for the sheet S to move so that the position on the sheet S where the operation error has occurred in the cutting execution process in the step S230, that is, where the cutter blade 61 is located at the time when positive decision is selected in the step S240 moves to the position downstream of the sheet hold down device 66. More strictly speaking, the distance between the cutter blade 61 and the sheet hold down device 66 is a distance from the cutter blade 61 to the downstream end of the sheet hold down device 66 in the transportation direction.

In the second embodiment which is configured as mentioned above, when cutting of the sheet S is re-executed, the sheet S is pressed by the sheet hold down device 66 after the position on the sheet S where a cutting error has occurred during cutting is moved to the position downstream of the sheet hold down device 66. Accordingly, even if the sheet S has received damage from the cutting error, the cutting can be re-executed avoiding the damage, thereby ensuring reliable cutting of the sheet S.

In a modified example of the second embodiment, a predetermined distance that the sheet S is transported may be less than the distance between the cutter blade 61 of the cutter unit 60 and the sheet hold down device 66. This configuration also enables re-execution of cutting of the sheet S at a position different from where the cutting error has occurred, thereby facilitating cutting of the sheet S.

C. Third Embodiment

The third embodiment of the invention will be described. The printer according to the third embodiment has a similar configuration as that of the second embodiment, but differs from the printer of the second embodiment as follows. In the second embodiment, when cutting is re-executed, the sheet S is transported by a predetermined distance in the step S310. In the third embodiment, the sheet S is transported in the same manner but at a different transport rate. Although the transport rate is not specifically described in the second embodiment, the transport rate remains the same as that of the transportation before the occurrence of the operation error that stops the cutter carriage 62. On the other hand, in the third embodiment, the sheet feeding motor 81 is adjusted such that the sheet S is transported by a predetermined distance during re-execution of cutting at a transport rate slower than that of transportation before the occurrence of the operation error that stops the cutter carriage 62.

The third embodiment configured as mentioned above has the following advantageous effect. During the operation error that stops the cutter carriage 62, wrinkles or breaks may be formed on the sheet S, and the extent of the wrinkles or breaks may increase when the sheet S is transported. In this embodiment, the sheet S is transported at a slower transport rate, thereby decreasing the risk that the extent of the wrinkles or breaks may increase.

D. Fourth Embodiment

The fourth embodiment of the invention will be described. Similarly to the third embodiment, the printer according to the fourth embodiment has a similar configuration as that of the second embodiment but differs from the printer of the second embodiment as follows. In the second embodiment, when cutting is re-executed, the sheet S is transported by a predetermined distance in the step S310. In the third embodiment, the sheet S is transported in a different manner from that of the second embodiment.

In the second embodiment, during re-execution of cutting of the sheet S, the sheet S is transported by using all the rollers provided in the transportation mechanism 40 and the cutter unit 60 by driving the sheet feeding motor 81, which is the same manner as that before the occurrence of the operation error that stops the cutter carriage 62. On the other hand, in the fourth embodiment, the sheet S is transported during re-execution of cutting of the sheet S by using only the rollers provided in the transportation mechanism 40 without using the pair of discharge rollers 68 provided in the cutter unit 60. Specifically, the driving roller 68*a* constituting the pair of discharge rollers 68 is spaced apart from the sheet S so as not to drive the pair of discharge rollers 68. In this configuration, the sheet S is transported by a predetermined distance during re-execution of cutting of the sheet S by using only the rollers disposed upstream of the cutter blade 61.

According to the printer of the fourth embodiment configured as mentioned above, the sheet S is not pulled by the rollers disposed downstream of the cutter blade 61. Accordingly, even if damages such as wrinkles or breaks are formed on the sheet S, the extent of the damages does not increase by pulling the sheet S during the occurrence of the operation error that stops the cutter carriage 62.

E. Modified Embodiments

E-1. Modified Embodiment 1

Although the above embodiments and modified embodiments have been described that the cutter carriage moves in the width direction of the recording medium so as to sequentially cut the recording medium in width direction, the cutter blade may have a length equal to or longer than the width of the recording medium so as to cut the recording medium in a guillotine-like manner.

E-2. Modified Embodiment 2

Although in the above embodiments and modified embodiments, the sheet S as a recording medium is a roll paper which is wound in a roll, the sheet S is not limited to a roll paper, and other type of elongated paper sheet can be used. Further, the sheet S is not necessarily a paper sheet, and is applicable to other type of recording medium such as a film.

E-3. Modified Embodiment 3

Although the above embodiments and modified embodiments have been described that the cutter error detection unit detects an error in which the cutter carriage 62 stops, the cutter error detection unit can be configured to detect an operation error in which the moving speed of the cutter carriage 62 is lower than a predetermined level. Further, the above embodiments and modified embodiments have been described that the cutter linear encoder 86 detects when the cutter carriage 62 stops, the cutter error detection unit can be configured to use the rotation rate of the cutter driving motor 83 to detect an error.

E-4. Modified Embodiment 4

Although in the above embodiments and modified embodiments, the sheet hold down device 66 having a cuboid shape is used, a pressure roller may be used as an alternative. The pressure roller works as a transportation roller during transportation of the sheet S and stops to rotate to apply a pressing force in the sheet direction (down direction) during cutting of the sheet S. In other words, the sheet hold down device may be of any configuration as long as having a pressing force that is adjustable at least in two stages.

E-5. Modified Embodiment 5

Although the above embodiments and modified embodiments have been described that a plurality of images based on the print job data are printed on the recording medium continuously without leaving a space, the images may be printed continuously leaving a space of a predetermined distance. In this case, the interface position between adjacent images is set at the center of the space.

E-6. Modified Embodiment 6

Although the above embodiments and modified embodiments have been described ink jet printers, the invention is applicable to any printer other than ink jet printers, such as laser printers or impact printers. Further, the invention is not limited to printers and other type of recording apparatuses such as facsimiles may be alternatively used.

In the elements described in the above embodiments and modified embodiments, the elements other than those described in independent claims are additional and can be omitted as appropriate. The invention is not limited to the above embodiments and modified embodiments in any way, and can be implemented in various ways without departing from the principle of the invention.

What is claimed is:

1. A recording apparatus comprising:

a transportation unit that transports an elongated recording medium in a predetermined transportation direction which is parallel to a longitudinal direction of the recording medium;

an image recording unit that records a plurality of images on the recording medium;

a cutter for the recording medium disposed at a position downstream of the image recording unit in the transportation direction;

a hold down device that presses the recording medium with a predetermined pressing force and disposed at a position downstream of the cutter in the transportation direction;

a cutting execution unit that cuts the recording medium in a width direction by operating the cutter at a cutting position corresponding to the position of the image to be recorded on the recording medium with the hold down device being actuated;

a cutter error detection unit that detects an operation error of the cutter which may occur during cutting by the cutting execution unit; and a cutting re-execution unit that restarts the cutter with the hold down device applying the increased pressing force to the recording medium, when an operation error of the cutter is detected by the cutter error detection unit, wherein the cutting re-execution unit includes a cutter returning unit that returns the cutter to a home position which serves as the start point of the operation and is configured to restart the cutter after the cutter has been returned to the home position by the cutter returning unit, wherein the cutting re-execution unit includes a transportation execution unit that operates the transportation unit to transport the recording medium by a predetermined distance during the time period between returning of the cutter to the home position by the cutter returning unit and restarting of the cutter, and wherein the predetermined distance is equal to or more than a distance between a cutter blade of the cutter and the hold down device.

2. The recording apparatus according to claim 1, wherein the transportation execution unit transports the recording medium by a predetermined distance at a transport rate slower than a transport rate of the recording medium before execution of the cutting execution unit.

3. A recording apparatus comprising:

a transportation unit that transports an elongated recording medium in a predetermined transportation direction which is parallel to a longitudinal direction of the recording medium;

an image recording unit that records a plurality of images on the recording medium;

a cutter for the recording medium disposed at a position downstream of the image recording unit in the transportation direction;

a hold down device that presses the recording medium with a predetermined pressing force and disposed at a position downstream of the cutter in the transportation direction;

a cutting execution unit that cuts the recording medium in a width direction by operating the cutter at a cutting position corresponding to the position of the image to be recorded on the recording medium with the hold down device being actuated;

a cutter error detection unit that detects an operation error of the cutter which may occur during cutting by the cutting execution unit; and a cutting re-execution unit that restarts the cutter with the hold down device applying the increased pressing force to the recording medium, when an operation error of the cutter is detected by the cutter error detection unit, wherein the cutting re-execution unit includes a cutter returning unit that returns the cutter to a home position which serves as the start point of the operation and is configured to restart the cutter after the cutter has been returned to the home position by the cutter returning unit, wherein the cutting re-execution unit includes a transportation execution unit that operates the transportation unit to transport the recording medium by a predetermined distance during the time period between returning of the cutter to the home position by the cutter returning unit and restarting of the cutter, and wherein the transportation execution unit executes transportation of the recording medium by a predetermined distance by using a roller disposed at a position upstream of the cutter in the transportation direction without using a roller disposed at a position downstream of the cutter in the transportation direction.

4. A recording/cutting control method, comprising;

transporting an elongated recording medium in a predetermined transportation direction which is parallel to a longitudinal direction of the recording medium;

image recording for recording a plurality of images on the recording medium;

cutting the recording medium in a width direction by operating a cutter for the recording medium at a cutting position corresponding to the position of the image to be recorded on the recording medium with a hold down device being actuated, the hold down device pressing the recording medium with a predetermined pressing force and being disposed at a position downstream of the cutter in the transportation direction;

cutter error detecting for detecting an operation error of the cutter which may occur during cutting; and cutting re-executing for restarting the cutter with the hold down device applying the increased pressing force to the recording medium, when an operation error of the cutter is detected in the cutter error detecting;

wherein the above step is executed by processor of recording apparatus, wherein the cutting re-executing returns the cutter to a home position which serves as the start point of the operation and is configured to restart the cutting after the cutter has been returned to the home position, wherein cutting re-executing includes transports the recording medium by a predetermined distance during the time period between returning of the cutter to the home position and restarting of the cutter, wherein the predetermined distance is equal to or more than a distance between a cutter blade of the cutter and the hold down device.

* * * * *